US010327976B1

(12) United States Patent
Boushehri

(10) Patent No.: US 10,327,976 B1
(45) Date of Patent: Jun. 25, 2019

(54) PORTABLE WALKING AID DEVICE WITH WHEELS

(71) Applicant: Touba Saharnaz Boushehri, New York, NY (US)

(72) Inventor: Touba Saharnaz Boushehri, New York, NY (US)

( * ) Notice: Subject to any disclaimer, the term of this patent is extended or adjusted under 35 U.S.C. 154(b) by 0 days.

(21) Appl. No.: 15/938,875

(22) Filed: Mar. 28, 2018

Related U.S. Application Data

(60) Provisional application No. 62/481,166, filed on Apr. 4, 2017.

(51) Int. Cl.
*A61H 3/04* (2006.01)

(52) U.S. Cl.
CPC ..... *A61H 3/04* (2013.01); *A61H 2003/046* (2013.01); *A61H 2201/0161* (2013.01); *A61H 2201/0188* (2013.01); *A61H 2201/1207* (2013.01)

(58) Field of Classification Search
CPC ..... A61H 3/04; A61H 2201/0161; A61H 2201/1207; A61H 2201/0188; A61H 2003/046
See application file for complete search history.

(56) References Cited

U.S. PATENT DOCUMENTS

| | | | | |
|---|---|---|---|---|
| 6,926,287 | B1 * | 8/2005 | Maher | B62B 9/06 280/47.4 |
| 7,657,968 | B2 * | 2/2010 | Levin | B60B 33/045 16/44 |
| 2012/0139202 | A1 * | 6/2012 | Sigbjomsson | A61H 3/04 280/47.34 |
| 2014/0265188 | A1 * | 9/2014 | Chang | F16D 59/02 280/47.4 |

* cited by examiner

*Primary Examiner* — Erez Gurari
(74) *Attorney, Agent, or Firm* — Manatt, Phelps & Phillips, LLP

(57) ABSTRACT

A walking aid device comprises a front support having front upper and lower ends and a handle at the upper end; a front wheel system connected to the front lower end; a back support having back upper and lower end; and a back wheel system connected to the lower end. The walking aid device optionally includes a brake device to brake the front and/or back wheel systems; and a folding mechanism connected to the front and back supports enabling the walking aid device to be compactly folder or stowed.

12 Claims, 15 Drawing Sheets

PORTABLE WALKING AID DEVICE WITH WHEELS

RELATED APPLICATIONS

This application claims priority to U.S. provisional application 62/481,166, entitled "PORTABLE WALKING AID DEVICE WITH WHEELS," filed Apr. 4, 2017, and incorporated herein by reference in its entirety.

FIELD OF THE INVENTION

The present invention relates to a portable walking aid device with wheels that is collapsible and assists the user to increase mobility and stability.

BACKGROUND OF THE INVENTION

Problems of mobility can result from many causes including injury, age, disease and disability. While the present invention intends to assist mobility issues caused by any of the foregoing, in particular, the subset for senior citizens and/or individuals requiring moderate assistance is most preferred.

Modern societies have seen substantial growth in the population of older citizens and the cost of health care is a significant budgetary concern. The science of aging has progressed enormously over the years driven by necessity. The world's population is growing older, due to rapid advances in medical science. In developed countries around the globe, today's average age expectancy is at least eighty years old. Hence, mobility is a must for seniors and it also an issue for patients in rehab. The vast increase of people running on concrete surfaces and the engagement in a variety of sports results in an inevitable and parallel increase in muscle and ligament injuries. This means there is an added market for a device that assists in recovery whilst mobility is limited.

As we age we undergo musculoskeletal deterioration which in turn affects how we move. Social contact with family and friends is adversely affected through reduced mobility. In itself, this has deleterious psychological as well as physiological consequences.

The cost and availability of home care for senior citizens is significant. Balancing the budget for the government facing expanding medical bills, is of overwhelming concern, and is a highly controversial political issue. Not all costs are covered by insurance whether private or governmental, and some of this price burden falls upon the individual. Being out of pocket is worrying for the elderly, who try to make ends meet, or whose pensions are limited.

Stability is also important for seniors. In a recent news report by the Centers for Disease Control and Prevention researchers claim elderly people are suffering brain injuries due to falls that are occurring at an increased rate. The research attributes the rapid rise to the fact that a growing number of elderly people are living at home. It is at home that repeated tumbles and falls occur. The report states that one in every forty five Americans seventy five years old and older suffered brain injuries that resulted in emergency department visits, hospitalization or deaths in 2013. Furthermore, there is a devastating upward trend in these resulting injuries. There was a 76% increase from 2007 to 2013 in this age group.

Current traditional walking aids and devices such as walking sticks, canes, scooters, wheelchairs, walkers, crutches, rolators, and such are helpful. However, they are not entirely satisfactory in assisting mobility and independence. While they do provide the user with increased mobility the users actions are limited. In addition the user may not always feel stable using these devices. The actions that the user takes can be quite limited. Can a senior citizen scooter to change the TV channel in the sitting room? Is a wheelchair always appropriate to go from bed to the bathroom? A cane is a traditional walking aid but is limited in enhancing mobility. Walkers force the senior citizen into a crouching position that might affect the muscles of the back. Crutches can often be difficult to handle. In these and a multitude of other circumstances, this walking device addresses diverse situational needs.

The present invention provides an advantage over these known traditional devices by providing, in some embodiments, a compact, light weight walking aid device made, for example, of a front horizontal tubular column for steering including a handle and hand break at the top end and a sprint and front wheel system at the bottom end; attached to a back tubular column. In some embodiments, the back tubular column is connected to the front column by a metal plate at the top end, a folding mechanism at the lower end and a back wheel system at the bottom end.

None of the walking aid devices are believed to provide the unique structure of various embodiments of the invention device which advantageously uses light weight materials. An advantage of the present invention over these known devices is in the provision of a device which provides the user with mobility and stability as well as being compact, portable and can be used easily. Moreover, the present invention is economically affordable for the consumer as compared to various known devices.

Therein, the invention features: affordability; portability; stability; mobility; foldability; liftability. Social services benefit from the invention, as does the senior citizen who finds an enhanced independence of living and an improved quality of life. Age related chronic sickness and disability are part and parcel of the cycle of life, but expectations about how later life is to be spent and enjoyed are the focus of much research and ever increasing attention. The device meets the concerns raised by this research. Given to the desire for seniors to engage in physical activity and social intercourse, despite problems relating to mobility, stamina, balance, joint flexibility, agility, walking speed, and physician condition, an invention that encourages movement is an undoubted benefit in the ongoing battle against the manifold problems of increasing age.

The invention device advantageously facilitates the moving from point A to point B. However, there are a whole host of other related benefits that accrue from use of various embodiments of the invention. With increased mobility, research shows that these benefits are cumulative; blood pressure regulation; weight control; cardiovascular improvement; osteoporosis mitigation; diabetic disease control; even possible cancer prevention is attributed to increased movement. New scientific strategies on countering age related issues focus inexorably on improvement in mobility.

Neglect of regular motion in joints, gait, posture, ability to transfer from one surface to another produces problems in the last quarter of life. What is natural in early life, namely basic movement, require skills that this handy device enhances in a multipurpose and practical way.

With the onset of arthritis and rheumatism, the senior citizen takes shorter steps and strides, has reduced ankle extensions, and abridged pelvic rotations. The skeletal and muscle deficits of declining age and senescence cannot be completely eliminated but they can be ameliorated and addressed by this invention and even longevity may be improved.

Just going outdoors, coping day to day, facing the dangers of falling, pressing the pause button on immobility, preventing fractures because neuromuscular functions become uncoordinated—all these are problems that are rendered less critical by this invention.

SUMMARY OF THE INVENTION

The present invention advantageously addresses generalized frailty with the possibility of a dignified carriage, and an upright posture. The senior citizen is understandably shy of advertising old age and disability. Veneration of the aged is less and less a current cultural value. This device according to some embodiments, unlike a walker, advantageously promotes a youthful upright posture.

Travel is less restricted. Folded and carried aboard, the senior citizen is enabled to travel by plane, train, car or bus and enjoy life away from the constrictions of the four walls of home.

There is a psychological advantage to freedom of movement. Mental health is a huge component of healthcare policy at the governmental level as well as at the personal and medical levels. The connection between mental health and exercise has been proven. This invention provides the means toward gentle, regular walks, thereby allaying and alleviating the depression, anxiety, and stress that are symptomatic of old age. Self esteem, indeed self confidence improves with independence, and this in turn reduces the incidence of depression and loss of social contact.

When home care is limited, which it inevitably is, given that even families are hard pressed to look after grandparent and parents, and social services struggle to look in for an hour or two, such an invention alters the picture of home bound, lonely and disabled existence. The senior citizen can cope; go to the kitchen and cook; turn on the TV; take the dog for a walk; feed the cat unaided; water the plants on the windowsill; embrace the flowers and fresh air in the garden; shop at the local grocery store; run small errands unaided; just amble round to the neighbor for a gossip and a cup of tea.

It cannot be overemphasized that, in some embodiments, the invention advantageously is not just compact, and portable, and foldable, it is also freestanding. It will not topple over, of its own accord, if not leant against a wall.

Since the device is light in weight, the senior citizen is not impeded in carrying it. In some embodiments, the invention can also optionally and beneficially be stored in a small space, because it is compact and can be folded. This is important for many reasons including those family outings when the device can be easily fitted into the boot of the car, without undue fuss and bother. Visits to family, neighbors and friends are facilitated with the invention. It is genuinely a third leg up without heavy, expensive equipment, besides negating a natural tendency toward a sedentary life that seniors and/or partially disabled might be tempted to fall into.

In some embodiments, the invention provides a device that is portable, compact, foldable and freestanding.

In some embodiments, the invention provides an ultra-light device to enable the user to easily carry, lift and store the device in a small space, such as a car, bus, at the bedside, bathroom, etc.

In some embodiments, the invention provides a walking aid that is stable and balanced to aid the user in moving without injury or falling.

In some embodiments, the invention provides a mobility aid engaging innate human ability to proceed in an upright/forward motion independently in a stable manner.

In some embodiments, the invention provides the user with improved functional mobility at an affordable price.

In some embodiments, the invention increases the user's leg muscles which are strengthened with use of the device.

In some embodiments, the invention diminishes the weakness from reduced ability to support body weight.

In some embodiments, the invention provides the user with added security and confidence when the device is placed by their chair, bed or toilet seat.

In some embodiments, the invention improves rehabilitation of the user increasing the user's joint range of motion and standing balance.

In some embodiments, the invention assists seniors and/or the disabled towards a better quality of life. Training for "elderliness" intimidates and the device lightens the load of the experience unobtrusively.

In some embodiments, the invention provides a padded hand grip with a hand brake located next to the foam grip to ensure single hand stop/start functionality. The grip is for either left hand or right hand functionality.

In some embodiments, the invention provides a device with a unique construction that absorbs shock and adjusts to changes in surface levels enabling continuous gliding forward movement. The optional forward propulsion eliminates the requirement to lift the device when crossing from pavement to road, eliminating breaking the natural motion of forward movement, whether at home, in the city or in the country.

In some embodiments, the present invention provides a walking aid device comprising a front horizontal tubular column (1) for steering. The front column at the top end includes a handle (6) and a brake (7) and at the bottom end includes a spring (8) and a front wheel system (4).

A back tubular column (2) is connected to the front column by a metal plate (9) and a folding mechanism (3); wherein said bottom end of the back column includes a back wheel system (5).

In some embodiments, the front wheel system (4) is comprised of at least three wheels and the back wheel system (5) is comprised of at least two wheels.

In alternate embodiments, the front wheel system (4) is comprised of at least six wheels and the back wheel system (5) is comprised of at least two wheels.

In some embodiments, a walking aid device includes a front support having front upper and lower ends, and a handle at the upper end; a front wheel system connected to the front lower end; a back support having back upper and lower end; and a back wheel system connected to the lower end. The walking aid device optionally includes a brake device to brake the front and/or back wheel systems; and a folding mechanism connected to the front and back supports enabling the walking aid device to be compactly folder or stowed.

Other objects, features and advantages of the present invention will be apparent when the detailed description of the preferred embodiments of the invention are considered with reference to the drawings, which should be construed in an illustrative and not limiting sense.

BRIEF DESCRIPTION OF THE DRAWINGS

The foregoing summary, as well as the following detailed description of preferred embodiments of the assembly, will be better understood when read in conjunction with the drawings. For the purposes of illustrating certain aspects of the present invention, there are shown in the drawings preferred embodiments. It should be understood, however, that the assembly is not limited to the precise arrangement, structures, features, embodiments, aspects, and methods shown, and the arrangements, structures, features, embodiments, aspects and methods shown may be used singularly or in combination with other arrangements, structures, features, embodiments, aspects and methods. The drawings are not necessarily drawn to scale and are not in any way intended to limit the scope of the invention, but merely to clarify various exemplary embodiments of the invention.

DETAILED DESCRIPTION OF THE INVENTION

Figure 1:
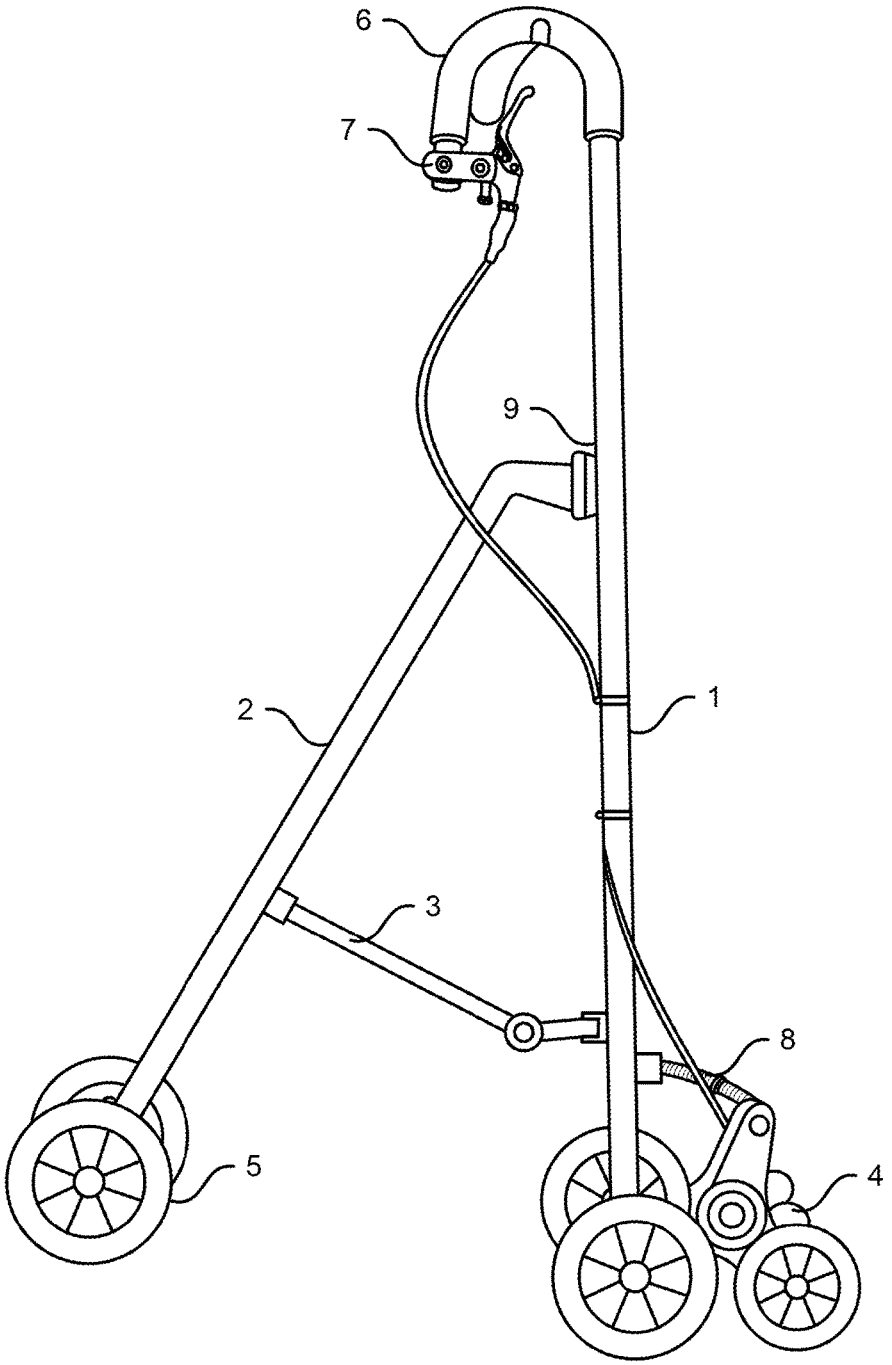
FIG. 1 is an illustration of the general features of the preferred device of the invention in an open position.
Figure 2:
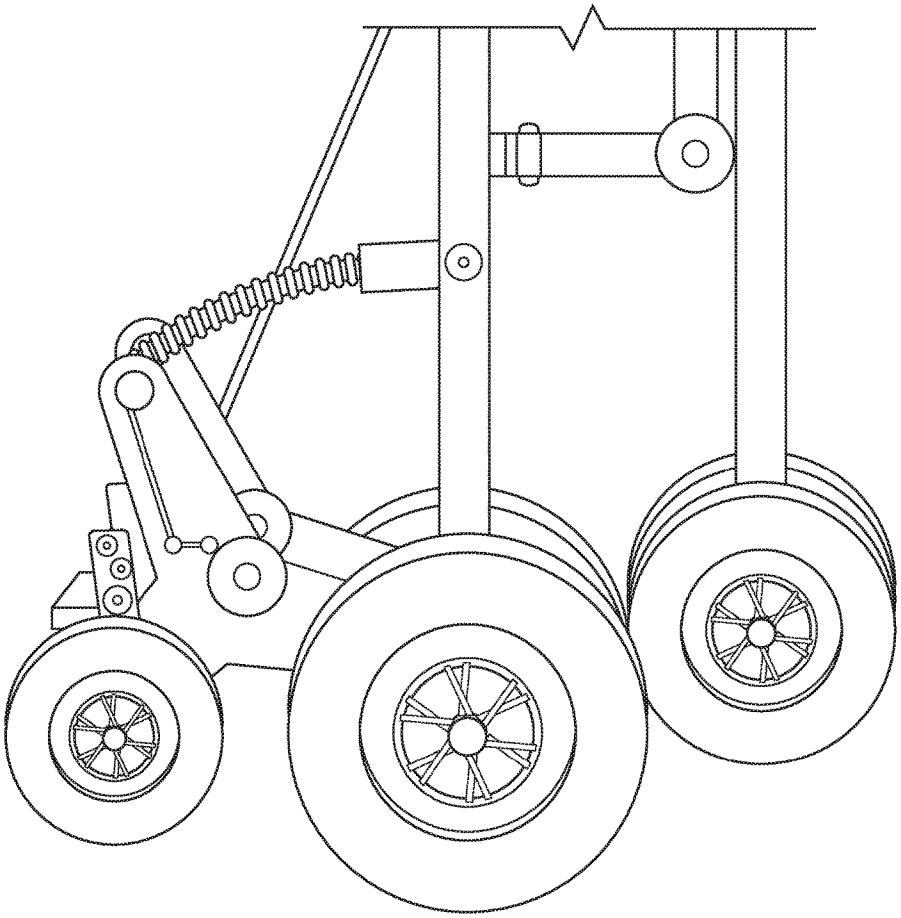
FIG. 2 is an illustration of the front and back wheel systems according to the invention in a closed position.
Figure 3:
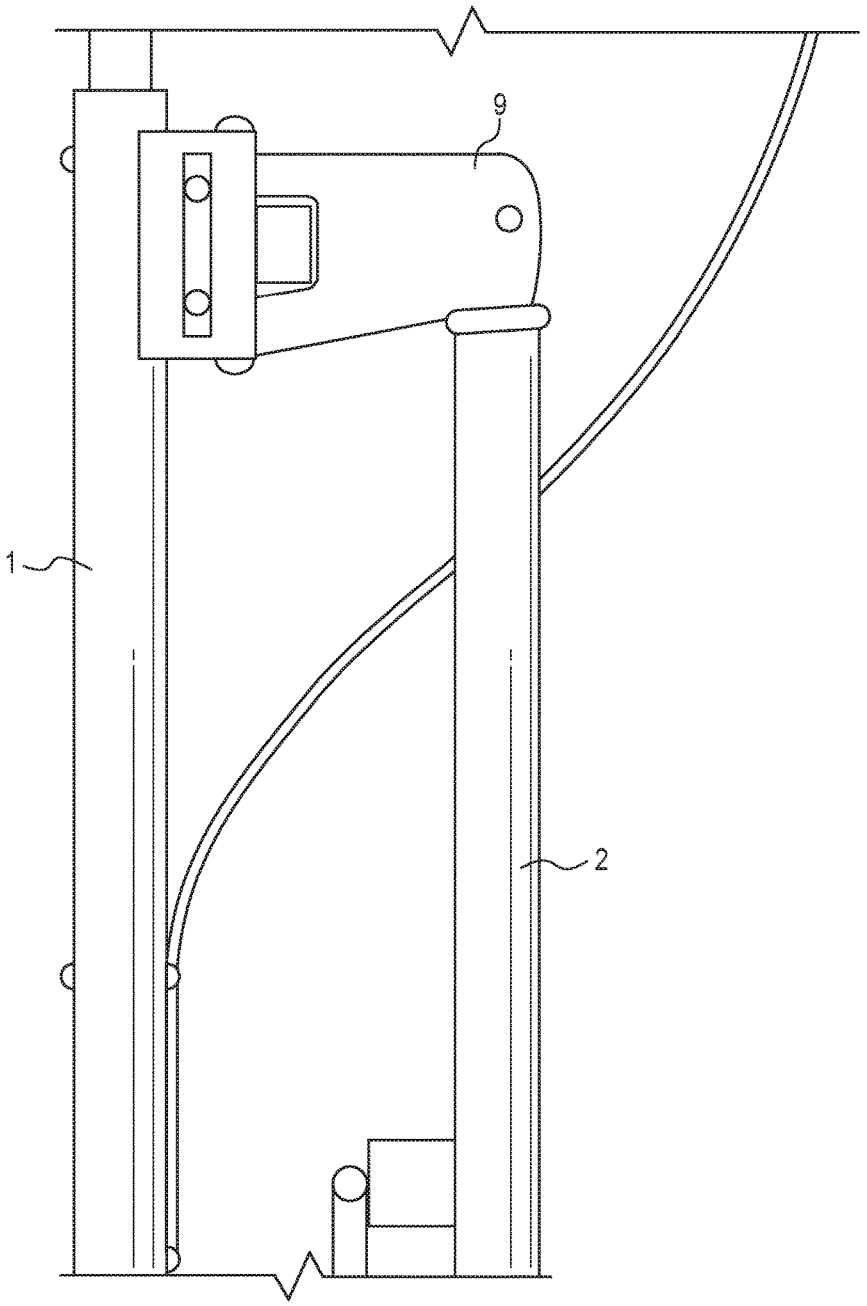
FIG. 3 is an illustration of the connection (9) between the front tubular column (1) and the back tubular column (2) according to the invention in a closed position, showing both front and back columns in a parallel position.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus the specific order of steps described herein is not to be considered implying a specific sequence of steps to perform the process. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

As used herein and illustrated in the drawings the following reference numerals refer to the structures indicated.

1. front tubular horizontal steering column.
2. back tubular column.
3. folding mechanism.
4. front wheel system.
5. back wheel system.
6. handle.
7. hand brake.
8. spring connector.
9. metal plate for attaching front and back columns.
10. tristar metal frame.
11. central hub.
12. trusses (with three prongs).

In accordance with some embodiments and as illustrated in FIG. 1, a walking aid device comprising a front horizontal tubular column (1) for steering, having at the top end a handle (6) and a brake (7) and at the bottom end a spring (8) and a front wheel system (4); and a back tubular column (2) connected to the front column by a metal plate (9) and a folding mechanism (3), having at the bottom end a back wheel system (5) is provided. In some embodiments, the tubular columns may be of rectangular or square shape, and different connection devices are used, such as screw, clamp plastic component, and the like.

The walking aid device according to some embodiments of the invention is illustrated in FIGS. 1 to 8. In some embodiments, a front wheel system (4) is comprised of at least three wheels and a back wheel system (5) is comprised of at least two wheels.

In some embodiments as illustrated in FIGS. 9 to 13, the front wheel system (4) is comprised of at least six wheels and the back wheel system (5) is comprised of at least two wheels. In this alternate embodiment, no hand brake is shown but could be included. In some embodiments, the connection (9) between the front tubular column (1) and the back tubular column (2) is configured such that in a closed position, both front and back columns are in a substantially parallel position.

Figure 10:
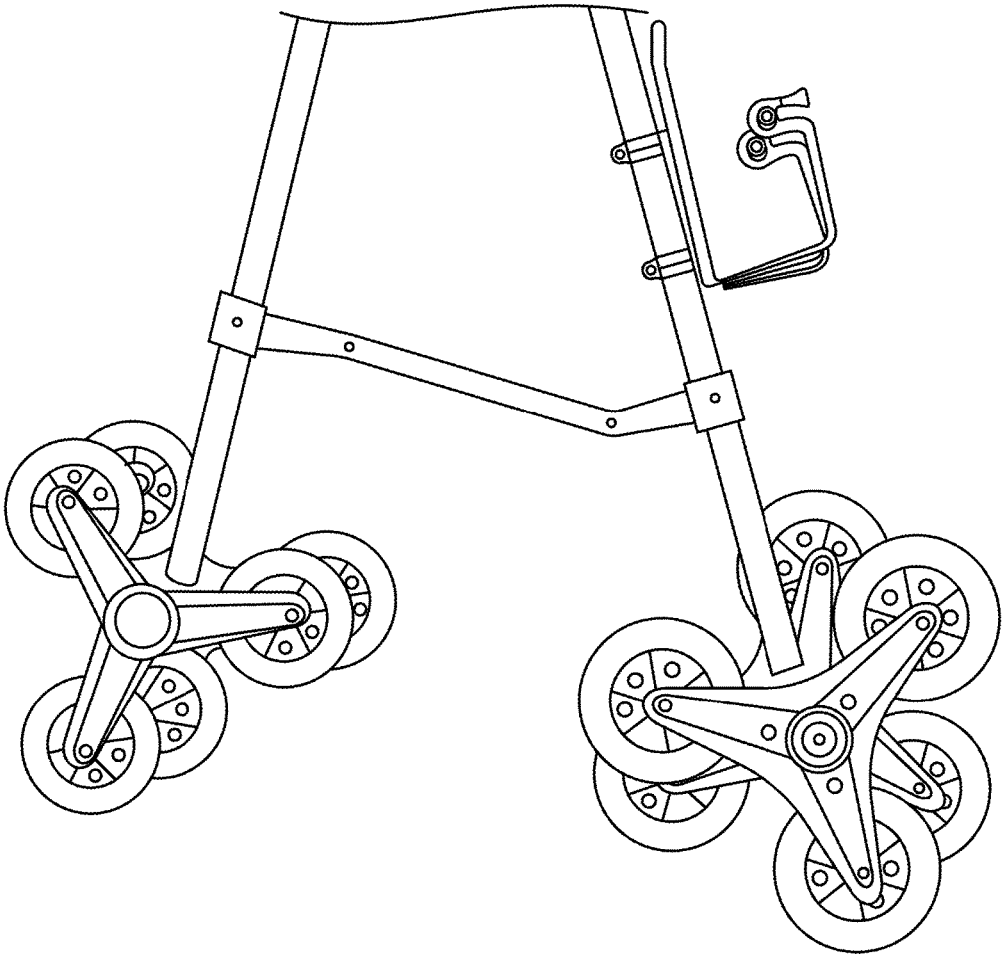
FIG. 10 is an illustration of an alternate embodiment according to the invention showing a front and back wheel system each having at least six wheels.
Figure 11:
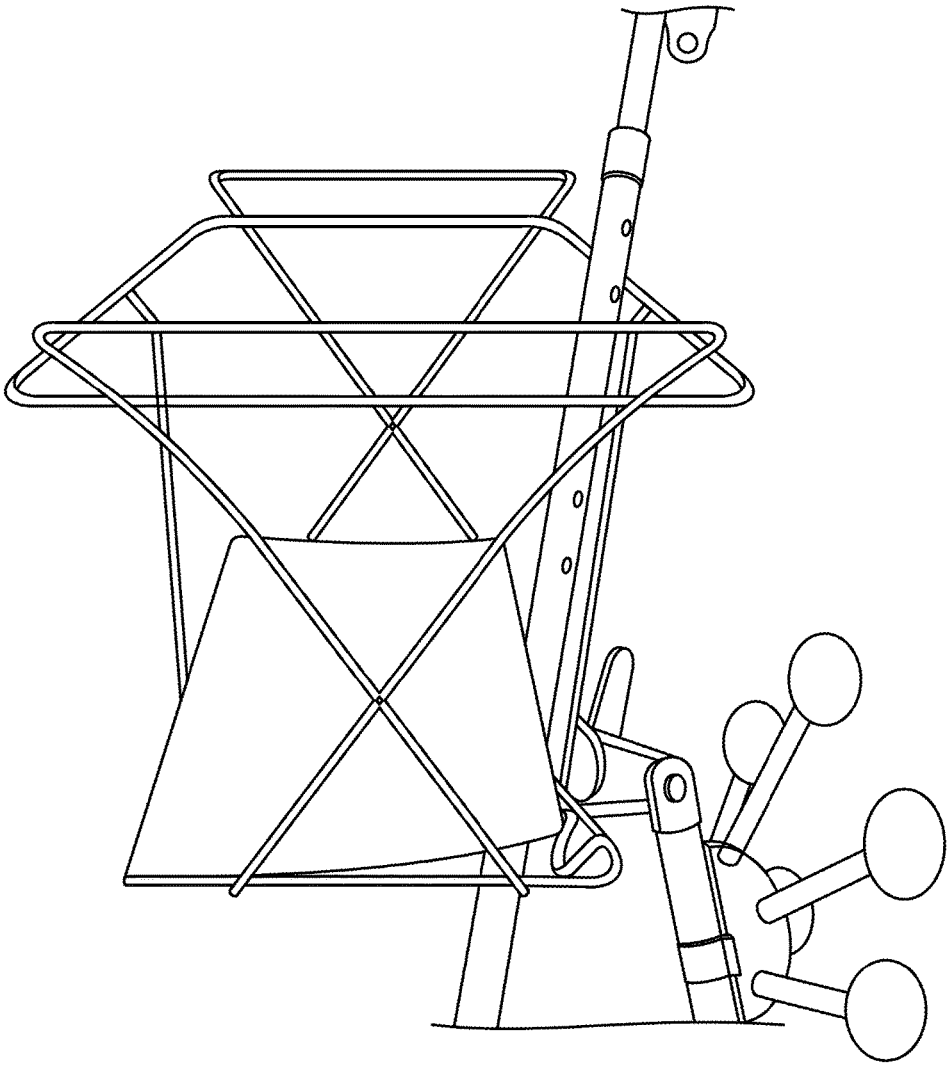
FIG. 11 is an illustration of a basket that can be attached to the front tubular column (1)
Figure 12:
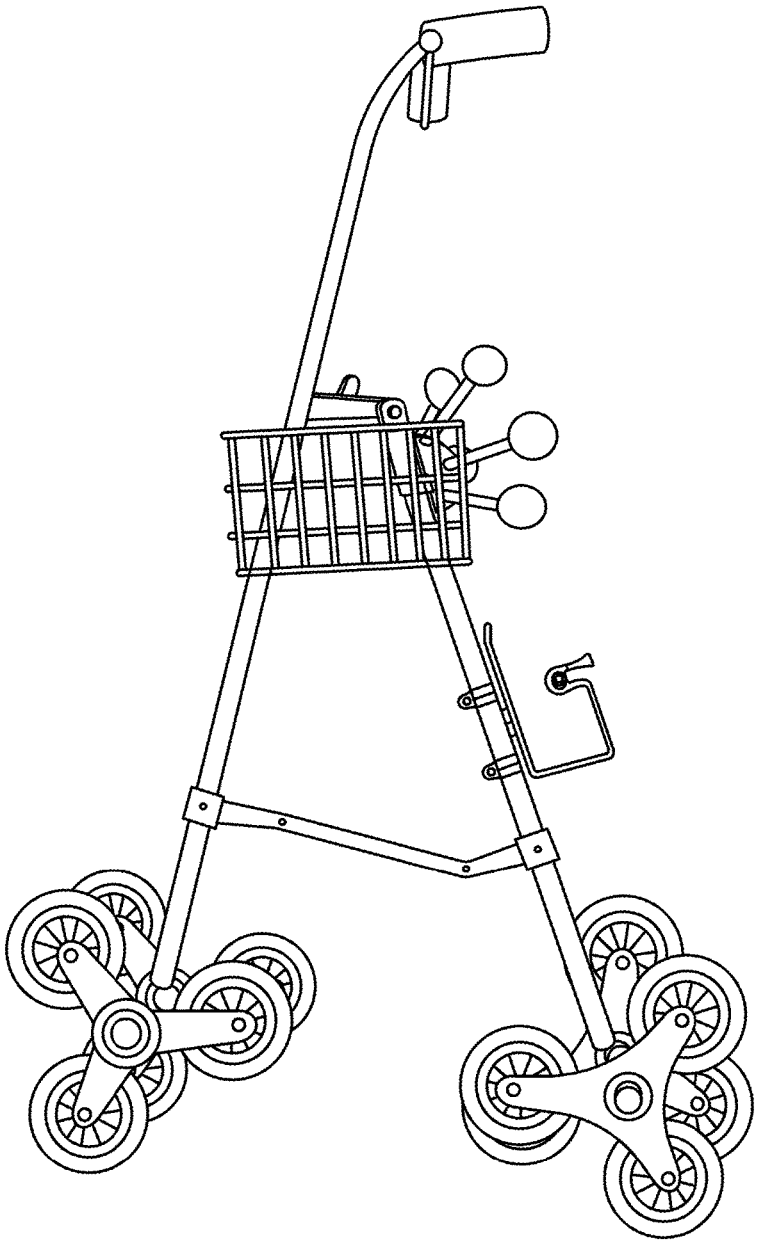
FIG. 12 is an illustration of the device according to the invention including optional elements such as a basket, an attachment with hooks and an attachment for a water bottle or oxygen tank.

FIG. 10 shows an embodiment where both the front and back wheel systems have at least six wheels.

In some embodiments, the inventive device is made of two or more tubular aluminum columns with sliding connection braces for folding/unfolding functionality.

A front steering column that has push button height adjustability or other adjustment mechanism is configured for the front column.

Two or more front or back, three dimensional metal trusses link the wheels to the principal aluminum columns. The metal plates of the trusses are linked to the wheels by means of a central bolt threaded through the body of the two trusses on each side of the tubular formation. The metal plates of the truss can be connected to either the front or back or both front/back of the central aluminum columns, ensuring structural stability and safety and providing for shock absorption.

A description of the front formation of a preferred version of the invention illuminates why this invention is fully functional as claimed. The portable walking aid device is built so that vertical energy for mobility which may be limited in the subject or person using the device, whether because of age, disability or injury can be transferred to enhanced rotary energy at the machine base, where three wheels are located and touching the ground, at all times. Provision is made in the portable walking aid device for stability, security, turn capable steering as well as braking. The analogy of the portable walking aid device to a stable three legged stool is useful. It relies on the math principle that any three points must lie in the same plane.

Figure 13A:
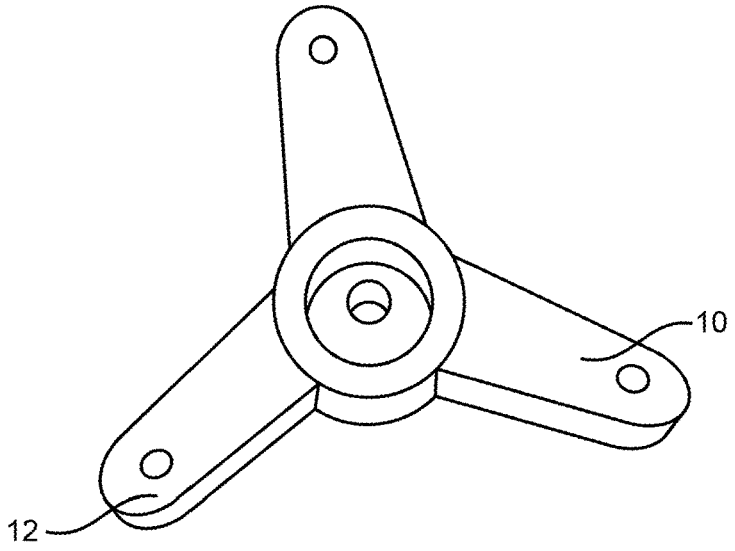
FIG. 13A is a side profile of the tristar metal frame for the front wheel system and FIG. 13B is a front profile of the frame.
Figure 13B:
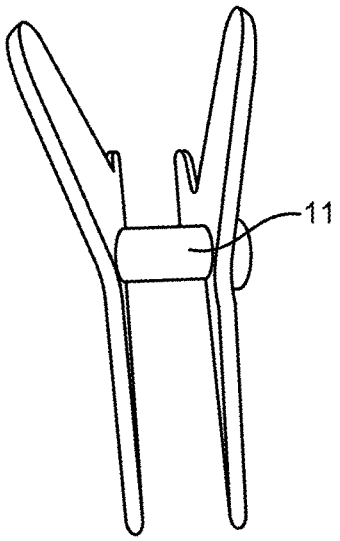
Figure 14A:
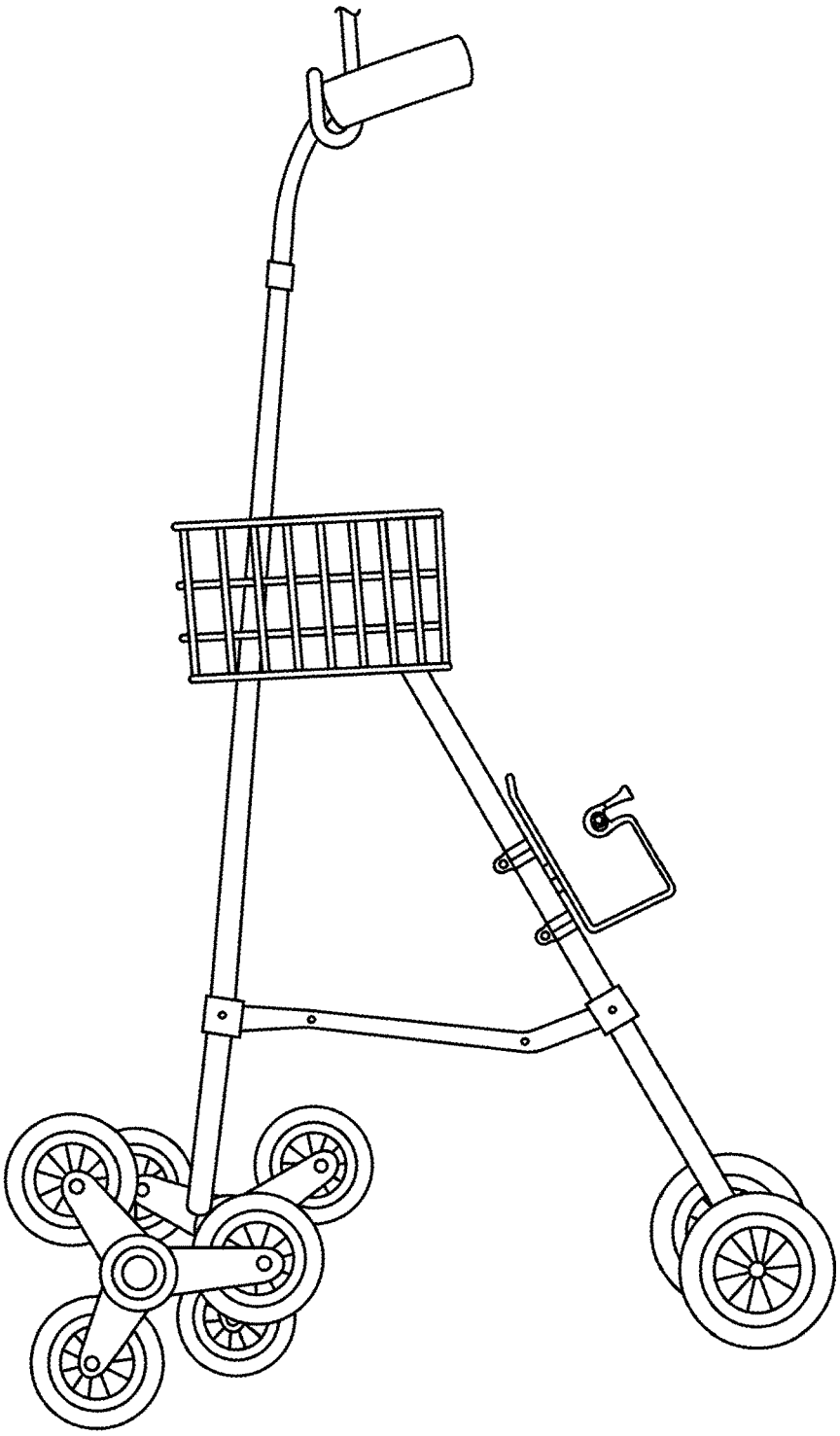
FIG. 14A is an illustration of the alternate embodiment of the invention in an open position having a front wheel system of six wheels and no brake.
Figure 14B:
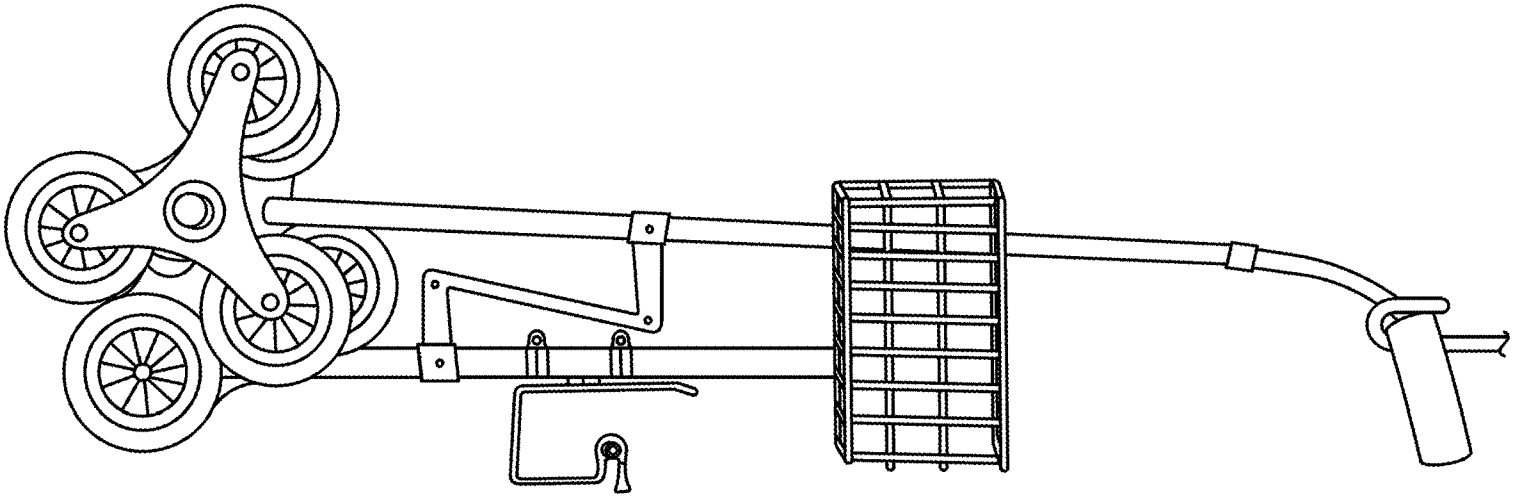
FIG. 14B is the embodiment in a closed position.

As shown in FIGS. 13A and 13B, use is made of a tristar metal frame 10 connected by a central hub (11). The central hub of the tristar frame remains in a fixed position or in some embodiments may rotate. Emanating backward from the central hub, one of the three trusses (12) is threaded through with a static rod. This rod connects through the base of the main front tubular column, passes through the supporting double truss, and thence connects to the two rotating wheels on either side of and aligned with the front tubular column. A windmill analogy has some use in this description.

A second double truss is connected by a spring mechanism and a U shaped joint to a position a set or predetermined distance, such as five inches, from the base of the principal front tubular frame. This is to provide extra control over bumps, and potholes, and changes in levels, as well as for extra steering control, and for turning. In operation, when the additional smaller wheel engages a surface, the spring may be engaged to allow the walking device to be more stably engaged with the overall walking surface. In some embodiments, wheels of different sizes or all of the same size may be used.

Figure 4:
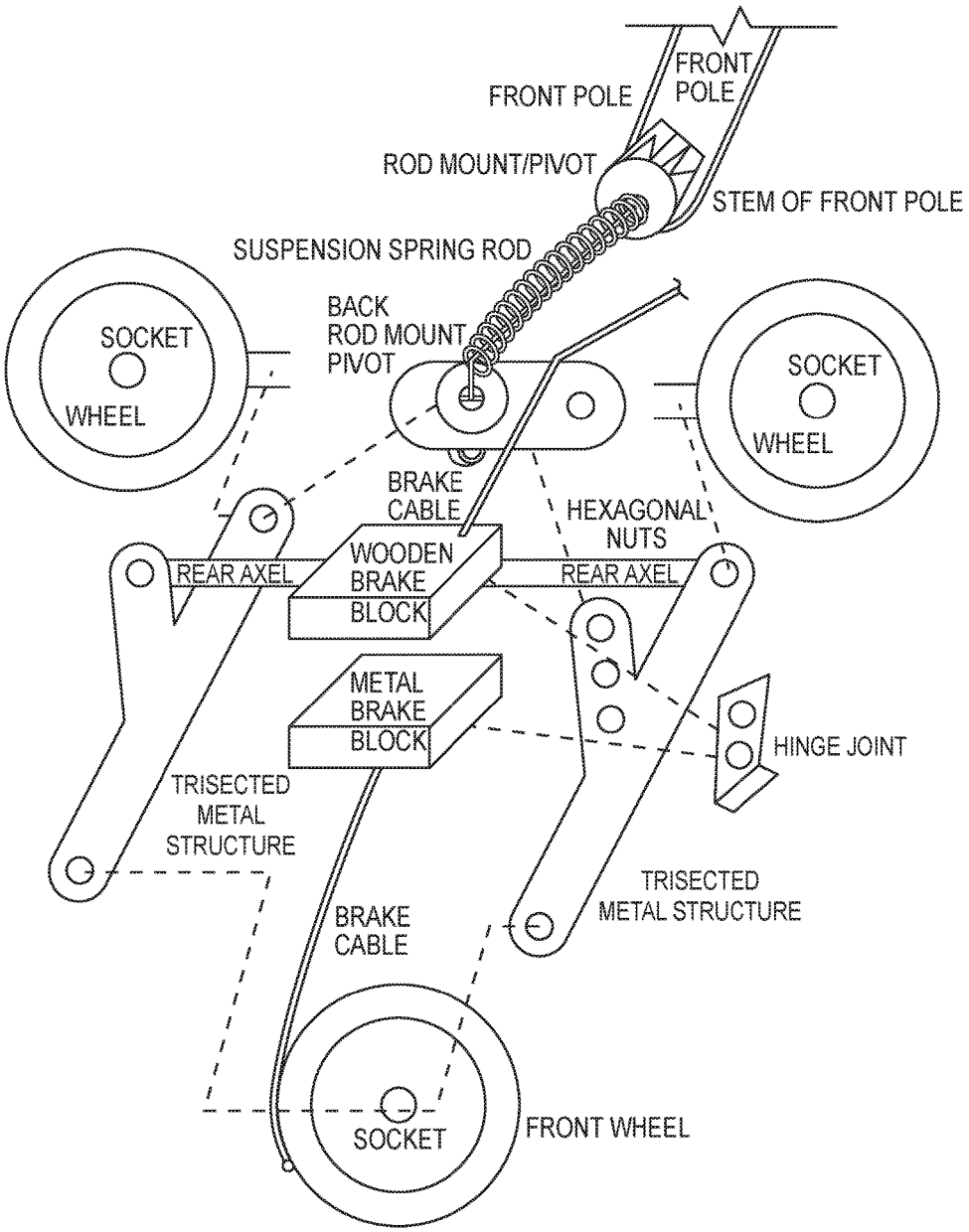
FIG. 4 is a partial exploded view of some embodiments of the walking device.
Figure 5:
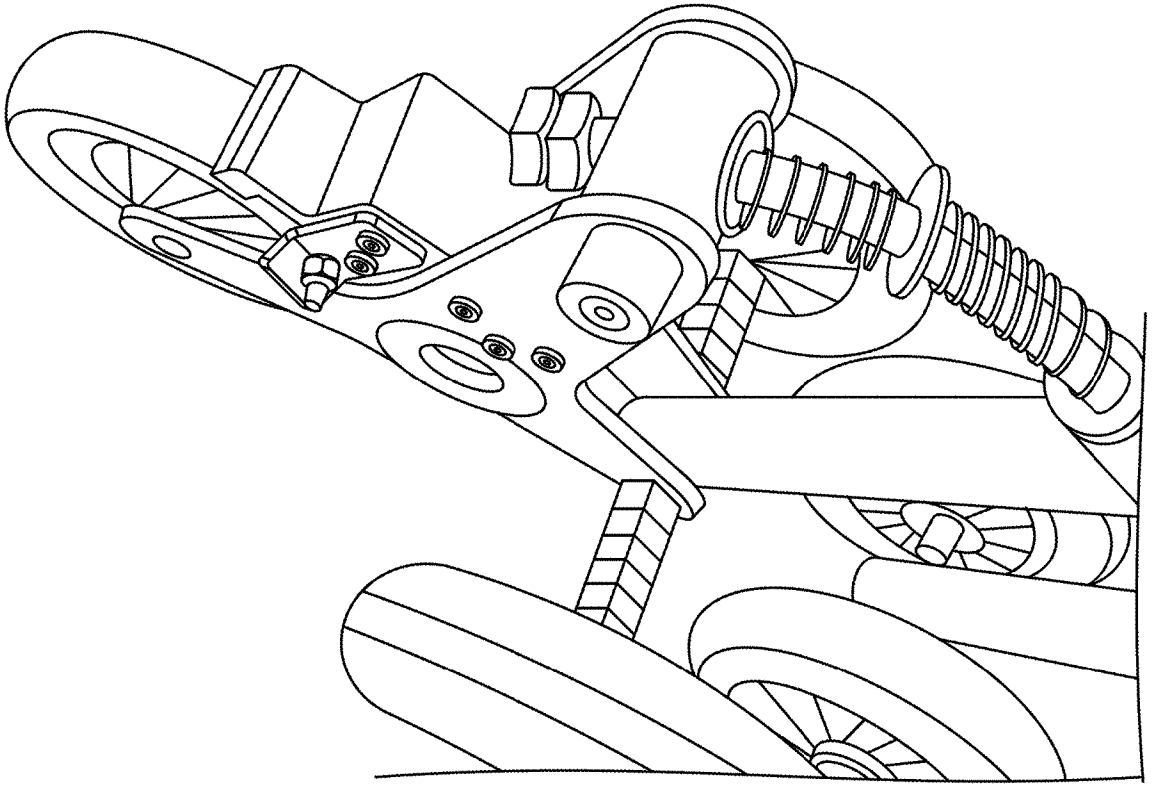
FIG. 5 is a close up frontal view of the front wheel system (4) showing the spring connector (8) according to the invention.
Figure 6:
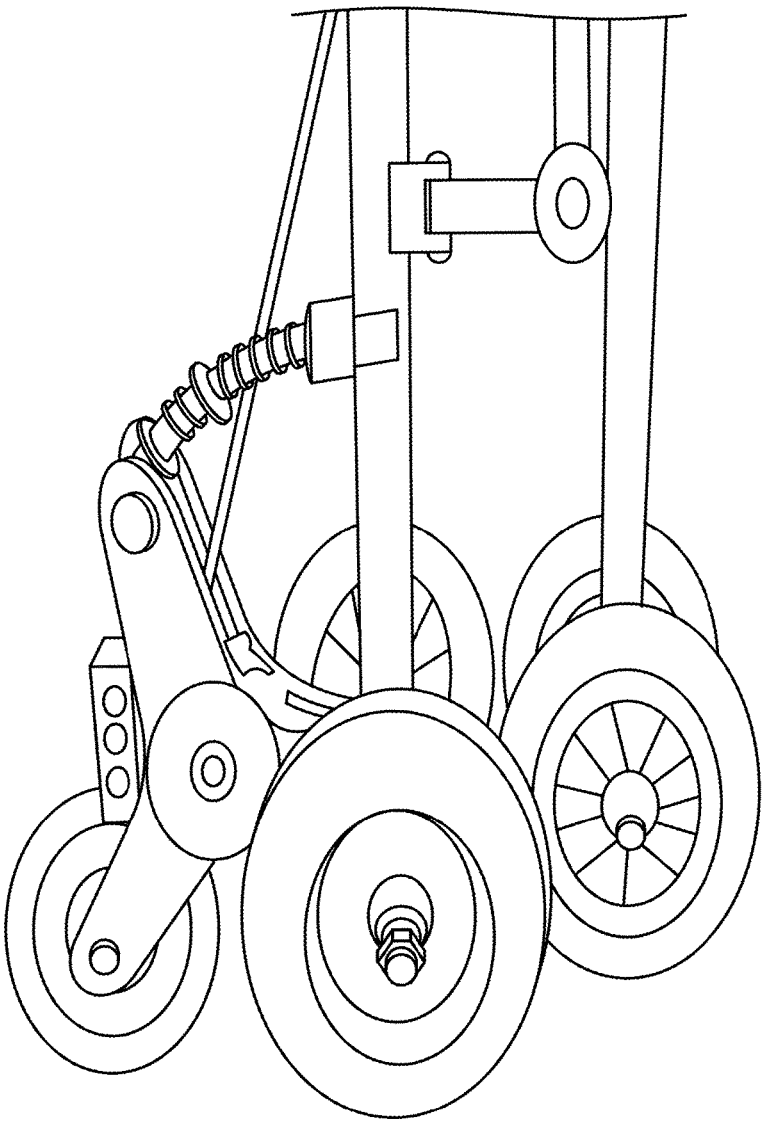
FIG. 6 is a close up side view of the front wheel system (4) showing the spring connector (8) and the back wheel system (5) in a closed position according to the invention.
Figure 7:
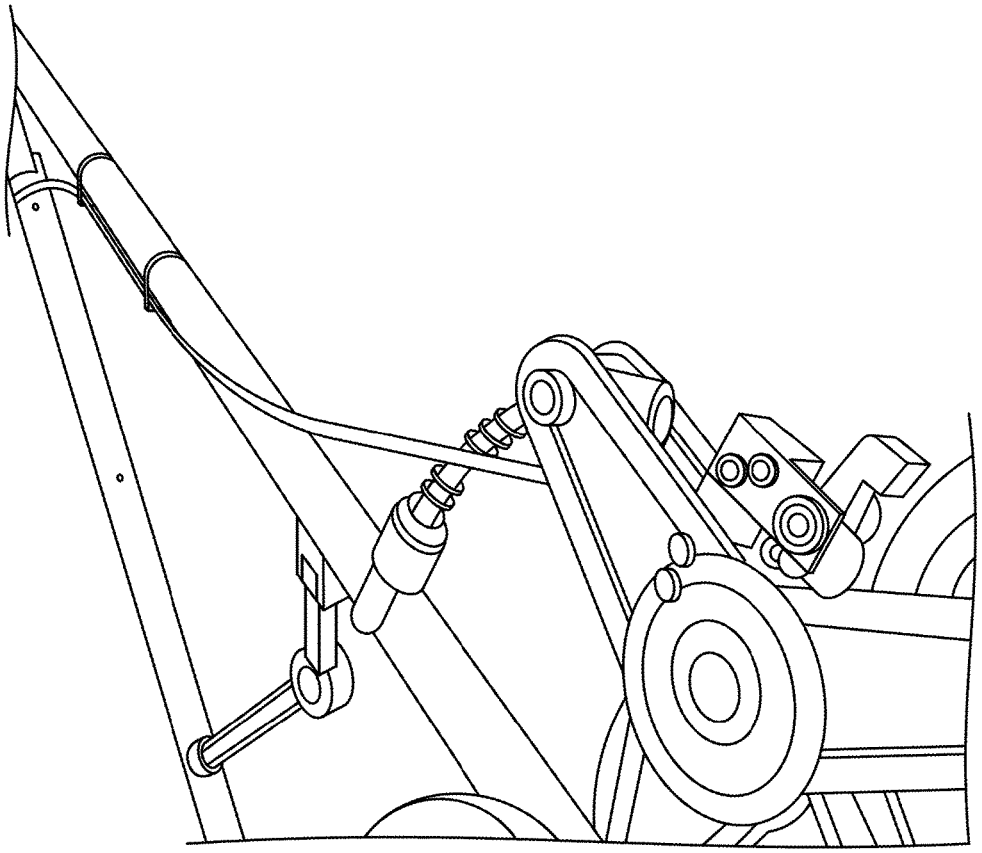
FIG. 7 is another view of the front wheel system according to some embodiments.
Figure 8:
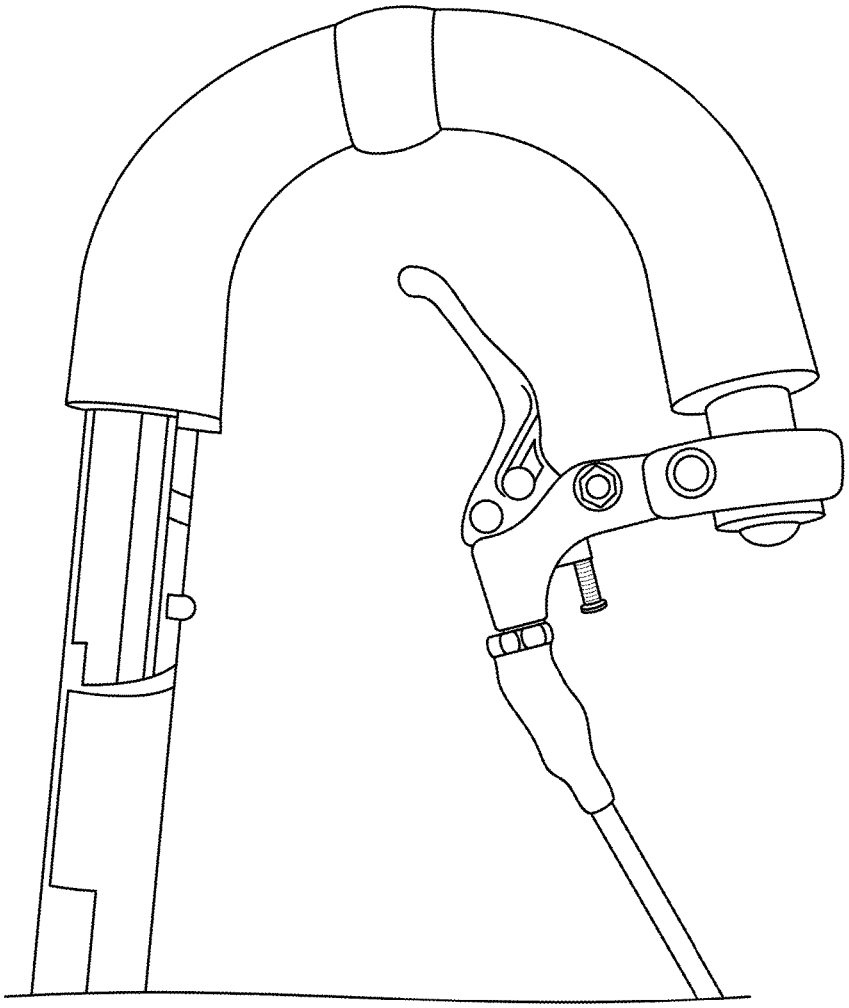
FIG. 8 is a view of the handle (6) and hand brake (7) according to the invention.
Figure 9:
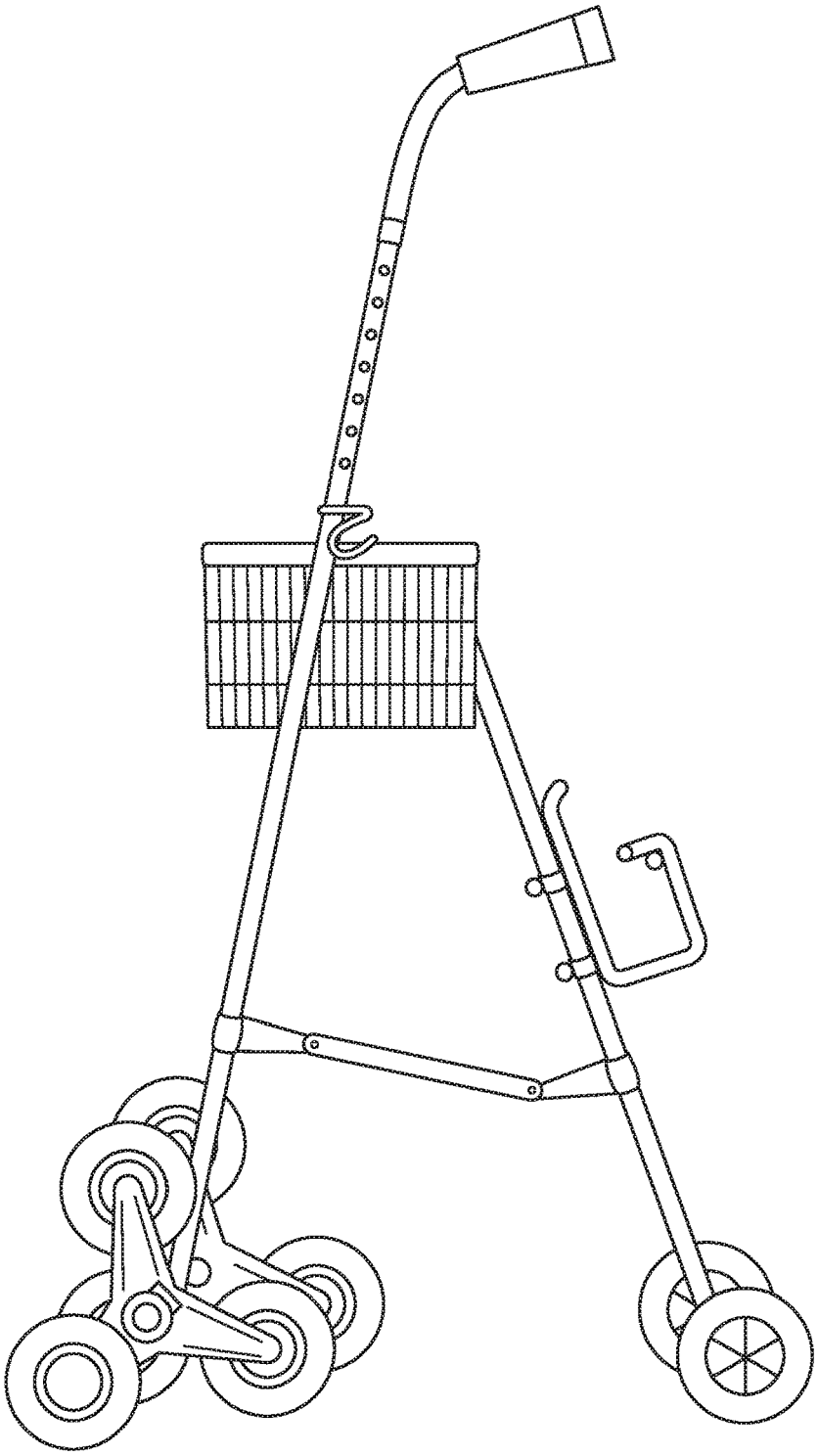
FIG. 9 is an illustration of an alternate embodiment according to the invention and includes a front wheel system of at least six wheels and no hand brake.

A third metal truss, coming from the central hub, encases the foremost or front wheel. It precedes by a set or predetermined distance, such as by eight inches the front tubular frame and by four inches the central hub. The brake cable or activation device passes down from the handle through to where this front wheel is connected. As shown in FIGS. 4 and 7, in some embodiments, the brake cable passes through an aperture of the wooden block and engages or is connected to the metal brake pad/block. In operation, when the hand brake engages or is activated, the brake cable engages the brake pad which then engages the wheel to slow or stop the walking device. In some embodiments, the brake pad is connected to the side trusses via a rotatable cylinder. In some embodiments, different materials for the components may be used, such as all metal/aluminum, all plastic, all wooden, and any combination.

In some embodiments, as illustrated in FIG. 4, the rear axle is inserted through two small openings at the stem of the front pole of the walking device. The axle exits these two openings and immediately threads through the parallel tips of one part of the trisected metal structure that is central to the functioning of the device. The axle is fastened with a number of hexagonal nuts. It is then inserted into sockets in the middle of two equidistant wheels, level with the base of the front pole of the device.

This is a preferred model or embodiment because of its extra functions, and also because at any one time all five wheels are touching the ground, and there are also two wheels connected to the principal back tubular frame.

In an alternate embodiment, shown in FIGS. 9, 10, 11, 13A, 13B, 14A and 14B, there is no spring or brake on the device. The front wheel system and all three metal trusses have wheels on them. This embodiment has the virtue of being less costly to produce but is stable nonetheless. Greater stability can optionally be provided for by extending the width of the two rods connecting the six wheels.

In some embodiments, the spring connector from the front aluminum column is connected to the smaller front wheel. This connector absorbs the shock of changes in surface levels while the device is used indoors or outdoors. It also ensures steering facility.

In some embodiments, the portable walking aid device includes a hand brake, a height adjustability feature, and/or modifiable back and front wheels. In some embodiments, portable walking aid device also includes a motorization feature to propel the device. This motorization feature can be electrical, solar and/or operated by battery. In some embodiments, portable walking aid device includes an attached unit with radiating hangers and/or hooks fixed to the rear pole enabling carriage of light weight items. In some embodiments, the walking aid device includes optional components such as an oxygen/bottle support, double side wire baskets for glasses, keys, mobile devices, medications etc. and a front basket. The walking aid device components can be made of aluminum, aluminum alloy, synthetic plastic material or any material that is lightweight and durable. In some embodiments, the height of the device is 3.5 ft having a weight of approximately 4 lbs and a width of 2 to 3 ft. In other embodiments, different height width and weight can be used.

In some embodiments, the walking aid device includes one or more compartments/pouches/device holders to hold/affix one or more additional touch or voice operated devices, including an emergency notification device, communication or mobile device, alarm, radio, recorder, light, key holder and/or stored data/music/entertainment. In some embodiments, the device includes a tracking system or other apparatus to remind the user where to put away, for example, the keys, glasses, mobile devices, and the like. In some embodiments, the walking aid device includes a battery used to recharge other devices and/or an electric motor to assist in walking. In some embodiments, the walking aid device can be plugged into an electric outlet to charge the battery and/or other devices connected thereo.

In some embodiments, the walking aid device includes an interface device with an interface such as a touch screen to select, for example, an alarm, emergency alarm, light and/or smart phone. In some embodiments, the walking aid device includes a base and/or holder to hold a variety of gadgets such as an alarm, smart phone, smart tablet, address book, phone book, calendar and/or appointment book.

In some embodiments, the walking aid device includes front and/or back lighting devices for basic safety precautions, such as poor ambient lighting or visually challenged users. In some embodiments, lightweight, high density LED lighting attached to the front central pole is located at the top of the hand grip. Thus situated, it is in proximity to the handle of the brake mechanism but does not interfere with it. This bright light enables the user to see very clearly in the dark. In some embodiments, the light is alkaline battery operated and is fitted with an easily accessible switch for the conventional three mode operation; full light; half-light; flashing and off. There is a mounting bracket but the lighting device can be detached from the bracket to be used as a flash light if needed.

In some embodiments, one or more lighting devices are attached by means of rubber rings, encircling the diameter of the poles, like watch straps. The lighting device at the front pole of the walking device resembles a small torch or bright light. At the back pole, the lighting device resembles a match box. These lights fit into mounting brackets in the center of the rubber rings, with screws threaded through for firm attachment. At the front pole, the torch shaped light is at a three o'clock angle to the grip. At the back pole, the lighting device is placed flat against the pole. Different models of bike lighting may be utilized. Some are not permanently attached, ensuring detachment and reinsertion as required for additional uses/applications. In some embodiments, the on/off switch for the lighting device is integrated into the walking device handle and pressing a protruding button or touch switch in or on the handle will activate or de-activate the lighting device.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A walking aid stick or cane device comprising:

a single front tubular column for steering; wherein said front column at the top end includes a handle and a brake;

a single back tubular column connected to said front column by a pivotable connection mechanism and a folding mechanism in a stick or cane configuration;

a front wheel system connected to the front lower end of said front support and comprising a tristar frame and at least three wheels including a front wheel and two back wheels, the tristar frame including first, second and third trusses, the first truss supporting the front wheel and the second truss supporting the two back wheels; and a spring mechanism connected to said single front column above the front wheel and the two back wheels in an arc configuration and to the third truss of said front wheel system and configured to absorb the shock of changes in surface levels when the front wheel engages the changes in surface levels and enabling rotation of the tristar frame around an axle connecting the two back wheels, wherein said bottom end of the back column includes a back wheel system; and wherein the folding mechanism is adapted to enable said front tubular column and said back tubular column to be folded together in the stick or cane configuration.

2. The walking aid device according to claim 1, wherein said front wheel system is comprised of at least three wheels and said back wheel system is comprised of at least two wheels.

3. The walking aid device according to claim 1, wherein said front wheel system is comprised of at least six wheels and said back wheel system is comprised of at least two wheels.

4. A walking aid stick or cane device comprising:

a single front support column having front upper and lower ends, and a handle at the upper end;

a front wheel system connected to the front lower end of said front support column and comprising a tristar frame and at least three wheels including a front wheel and two back wheels, the tristar frame including first, second and third trusses, the first truss supporting the front wheel and the second truss supporting the two back wheels;

a spring mechanism connected to said single front support column above the front wheel and the two back wheels in an arc configuration and to the third truss of said front wheel system and configured to absorb the shock of changes in surface levels when the front wheel engages the changes in surface levels and enabling rotation of the tristar frame around an axle connecting the two back wheels;

a brake device including an activation mechanism located at the upper end of said front support column, and a braking mechanism located at the bottom end activated responsive to the activation mechanism;

a single back support column having back upper and lower ends, and connected to said front column;

a back wheel system connected to the lower end of said back support column; and a folding mechanism connected to the front and back support columns enabling the walking aid device to be compactly folder or stowed in a stick or cane configuration;

wherein the folding mechanism is adapted to enable said front support column and said back support column to be folded together in the stick or cane configuration.

5. The walking aid device according to claim 4, wherein said front wheel system comprises at least three wheels and said back wheel system comprises of at least two wheels.

6. The walking aid device according to claim 4, wherein said front wheel system comprises at least six wheels and said back wheel system comprises at least two wheels.

7. A walking aid stick or cane device comprising:

a single front support having front upper and lower ends, and a handle at the upper end;

a front wheel system connected to the front lower end of said front support and comprising a tristar frame and at least three wheels including a front wheel and two back wheels, the tristar frame including first, second and third trusses, the first truss supporting the front wheel and the second truss supporting the two back wheels;

a spring mechanism connected to said single front column above the front wheel and the two back wheels in an arc configuration and to the third truss of said front wheel system and configured to absorb the shock of changes in surface levels when the front wheel engages the changes in surface levels and enabling rotation of the tristar frame around an axle connecting the two back wheels;

a single back support having back upper and lower end;

a back wheel system connected to the lower end of said back support column;

a brake device including an activation mechanism located at the upper end of one of said front and back supports, and a braking mechanism located at the bottom end activated responsive to the activation mechanism to brake at least one of said front and back wheel systems; and a folding mechanism connected to the front and back supports enabling the walking aid device to be compactly folder or stowed in a stick or cane configuration;

wherein the folding mechanism is adapted to enable said front support and said back support to be folded together in the stick or cane configuration.

8. The walking aid device according to claim 7, wherein said front wheel system comprises at least three wheels and said back wheel system comprises of at least two wheels.

9. The walking aid device according to claim 7, wherein said front wheel system comprises at least six wheels and said back wheel system comprises at least two wheels.

10. A walking aid stick or cane device comprising:

a single front support having front upper and lower ends, and a handle at the upper end;

a front wheel system connected to the front lower end of said front support and comprising a tristar frame and at least three wheels including a front wheel and two back wheels, the tristar frame including first, second and third trusses, the first truss supporting the front wheel and the second truss supporting the two back wheels;

a spring mechanism connected to said single front column above the front wheel and the two back wheels in an arc configuration and to the third truss of said front wheel system and configured to absorb the shock of changes in surface levels when the front wheel engages the changes in surface levels and enabling rotation of the tristar frame around an axle connecting the two back wheels;

a single back support having back upper and lower end and connected to the front support;

a back wheel system connected to the lower end of said back support column and comprising at least two wheels; and a folding mechanism connected to the front and back supports enabling the walking aid device to be compactly folder or stowed in a stick or cane configuration;

wherein the folding mechanism is adapted to enable said front support and said back support to be folded together in the stick or cane configuration.

11. The walking aid device according to claim 10, wherein said front wheel system comprises at least three wheels and said back wheel system comprises of at least two wheels.

12. The walking aid device according to claim 10, wherein said front wheel system comprises at least six wheels and said back wheel system comprises at least two wheels.

* * * * *